US009733592B2

(12) United States Patent
Okazaki

(10) Patent No.: US 9,733,592 B2
(45) Date of Patent: Aug. 15, 2017

(54) DEVELOPING DEVICE AND IMAGE FORMING APPARATUS

(71) Applicant: KONICA MINOLTA, INC., Chiyoda-ku, Tokyo (JP)

(72) Inventor: Futoshi Okazaki, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/820,997

(22) Filed: Aug. 7, 2015

(65) Prior Publication Data

US 2016/0070206 A1 Mar. 10, 2016

(30) Foreign Application Priority Data

Sep. 4, 2014 (JP) ..... 2014-179790

(51) Int. Cl.
*G03G 15/08* (2006.01)

(52) U.S. Cl.
CPC ..... *G03G 15/0891* (2013.01); *G03G 15/0893* (2013.01)

(58) Field of Classification Search
CPC ..... G03G 15/0891; G03G 2215/0819; G03G 2215/0827; G03G 2215/083; G03G 2215/0833
See application file for complete search history.

(56) References Cited

U.S. PATENT DOCUMENTS 8,892,006 B2 11/2014 Kubo
9,323,180 B2 4/2016 Kashimoto et al.
(Continued)

FOREIGN PATENT DOCUMENTS

JP 10186829 A 7/1998
JP 2010256701 A 11/2010
(Continued)

OTHER PUBLICATIONS

Japanese Office Action (and English translation thereof dated Dec. 6, 2016 issued in counterpart Japanese Application No. 2014-179790.
(Continued)

*Primary Examiner* — David M Gray
*Assistant Examiner* — Michael Harrison
(74) *Attorney, Agent, or Firm* — Holtz, Holtz & Volek PC

(57) ABSTRACT

A developing device has a first circulation tank and a second circulation tank. A developer is conveyed from the first circulation tank to the second circulation tank through a first opening, while the developer is partly discharged through an outlet. The developer conveyed to the second circulation tank is conveyed back in the first circulation tank via a second opening. A first screw provided in the first circulation tank has a first vane, which exerts a force in a conveying direction of the first circulation path, in a first portion upstream from the first opening with respect to the conveying direction. The first screw has no vanes in a second portion near the first opening. The first screw has a second vane, which exerts a force in a direction opposite to the conveying direction, in a third portion adjacently downstream from the second portion. The outlet is located at a point of the first circulation tank, downstream from the second vane. A portion of the first circulation tank downstream from the second vane is not connected to the second circulation tank in a direction perpendicular to the conveying direction.

7 Claims, 5 Drawing Sheets

(56) References Cited

U.S. PATENT DOCUMENTS

| | | | | |
|---|---|---|---|---|
| 2011/0150537 | A1* | 6/2011 | Watanabe | G03G 15/0839 399/256 |
| 2014/0205311 | A1* | 7/2014 | Kashimoto | G03G 15/0889 399/98 |
| 2015/0253694 | A1* | 9/2015 | Saito | G03G 15/0891 399/254 |

FOREIGN PATENT DOCUMENTS

| | | | |
|---|---|---|---|
| JP | 2012145729 | A | 8/2012 |
| JP | 2013120288 | A | 6/2013 |
| JP | 2014139630 | A | 7/2014 |

OTHER PUBLICATIONS

Japanese Office Action (and English translation thereof) dated Mar. 14, 2017, issued in counterpart Japanese Application No. 2014-179790.

* cited by examiner

DEVELOPING DEVICE AND IMAGE FORMING APPARATUS

This application claims benefit of priority to Japanese Patent Application No. 2014-179790 filed Sep. 4, 2014, the content of which is incorporated herein by reference.

BACKGROUND OF THE INVENTION

Field of the Invention

The present invention relates to a developing device and an image forming apparatus, and more particularly to a developing device that uses a two-component developer and that is resupplied with and discharges the developer as needed, and an image forming apparatus comprising the developing device.

A developing device that develops an electrostatic latent image formed on a photoreceptor drum with a two-component developer containing carrier and toner is well known as an example of developing devices to be employed in electrophotographic image forming apparatuses. In recent years, a trickle type developing device has been suggested. The trickle type developing device resupplies a developer, which contains toner and a tiny amount of carrier, to a developer tank in proportion as the toner consumption and discharges a fixed amount of developer from the developer tank.

In the trickle type developing device, it is important to keep the amount of developer in the developer tank at a constant level for maintenance of high quality of developed images. For this purpose, a screw provided in the developer tank to convey a developer has a vane for applying pressure to the developer in the conveying direction and a vane for applying pressure to the developer in the opposite direction. The pressure balancing achieved by these vanes allows adjustments of the amount of developer circulating in the developer tank and the amount of developer discharged from the developer tank so as to keep the amount of developer in the developer tank at a constant level. However, there is a risk of loosing the pressure balance due to an increase in the rotation speed of the developer conveying screw with an increase in the printing speed, thereby causing problems, such as discharge of too much developer, etc. In order to prevent the problems, Japanese Patent Laid-Open Publication No. 10-186829 discloses a developing device comprising a shutter system near an outlet for the developer so as to adjust the amount of discharged developer. In the following, this developing device will be referred to as a conventional developing device.

However, in a developing device provided with a shutter system as in the conventional developing device, there is a risk of causing convection of the developer near the shutter system, which causes trouble, such as closure of the outlet with the developer. Also, the shutter system has a complicate structure, and providing the shutter system results in an increase in the size of the developing device and an increase in the cost.

SUMMARY OF THE INVENTION

It is an object of the present invention to provide a developing device that is capable of keeping an appropriate amount of developer in the developer tank with a simple system as compared to a conventional developing device, and an image forming apparatus comprising the developing device.

A developing device according to a first aspect of the present invention is configured to develop an electrostatic latent image formed on an image supporting member with a developer containing toner and carrier, to be resupplied with a developer in proportion as toner consumption and to discharge a used developer, the developing device comprising:

a first circulation tank configured to discharge a part of the developer through an outlet while conveying the developer;

a second circulation tank divided from the first circulation tank by a partition wall, the second circulation tank configured to convey the developer conveyed thereto from the first circulation tank through a first opening made in the partition wall and the developer resupplied thereto through a resupply port to the first circulation tank through a second opening made in the partition wall such that the first circulation tank and the second circulation tank form a circulation pathway;

a first screw provided in the first circulation tank so as to convey the developer; and a second screw provided in the second circulation tank so as to convey the developer, wherein:

the first screw has a first vane in a first portion upstream from the first opening with respect to a conveying direction of the first screw, the first vane exerting a force in the conveying direction on the developer;

the first screw has no vanes in a second portion near the first opening;

the first screw has a second vane in a third portion adjacently downstream from the second portion with respect to the conveying direction, the second vane exerting a force in a direction opposite to the conveying direction on the developer;

the outlet is located at a point of the first circulation tank, downstream from the second vane with respect to the conveying direction; and a portion of the first circulation tank downstream from the second vane with respect to the conveying direction is not connected to the second circulation tank in a direction perpendicular to the conveying direction.

An image forming apparatus according to a second aspect of the present invention comprises the developing device above.

DETAILED DESCRIPTION OF THE PREFERRED EMBODIMENTS

Figure 1:
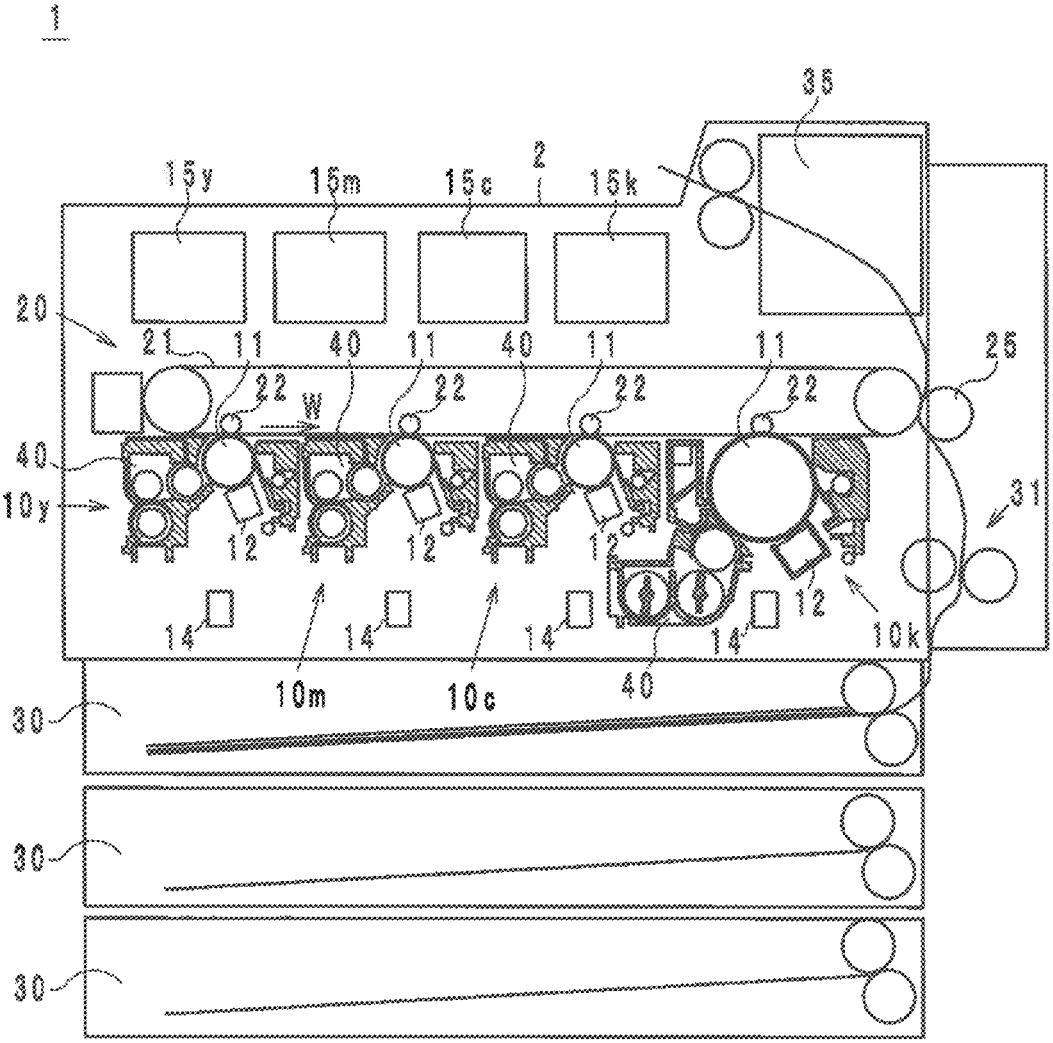
FIG. 1 is a schematic view illustrating an internal structure of an image forming apparatus comprising a developing device according to an embodiment of the present invention.

General Structure of Image Forming Apparatus; See FIG. 1

A developing device according to an embodiment of the present invention and an image forming apparatus comprising the developing device are described with reference to the drawings. In the drawings, the same members and the same parts are provided with the same reference symbols, and the same descriptions are not repeated.

An image forming apparatus 1 illustrated in FIG. 1 is an electrophotographic color printer of a tandem type. The printer generally comprises imaging units 10 (10*y*, 10*m*, 10*c*, 10*k*) configured to form toner images in colors of Y (yellow), M (magenta), C (cyan) and K (black), respectively, and an intermediate transfer unit 20. In the printer, further, hoppers 15 (15*y*, 15*m*, 15*c*, 15*k*) configured to resupply toner to the imaging units 10, respectively, are provided above the intermediate transfer unit 20.

Each of the imaging units 10 includes a charger 12, a developing device 40, etc. arranged around a photoreceptor drum 11. In each of the imaging units 10, the photoreceptor drum 11 is irradiated with a laser emitted from a laser scanning unit 14, and thereby, an electrostatic latent image is written on the photoreceptor drum 11. Then, the electrostatic latent image is developed by the corresponding developing device 40 into a toner image. Accordingly, toner images in the respective colors are formed on the photoreceptor drums 11. The intermediate transfer unit 20 includes an endless intermediate transfer belt 21 to be driven to rotate in a direction indicated by arrow W. By electric fields applied from first transfer rollers 22 opposed to the respective photoreceptor drums 11, the toner images formed on the photoreceptor drums 11 are transferred to the intermediate transfer belt 21 so as to be combined to form a composite image (first transfer). Such an electrophotographic process is well known, and a detailed description thereof is omitted.

In a lower section of the printer body, an automatic sheet feeder unit 30 is provided. The sheet feeder unit 30 is configured to feed recording sheets (which will be hereinafter referred to as sheets) one by one. A sheet is fed from a feed roller (not illustrated in the drawings) to a pair of timing rollers 31, and further fed to a nip portion between the intermediate transfer belt 21 and a secondary transfer roller 25. In the nip portion, the toner image (composite color image) is transferred to the sheet by an electric field applied from the secondary transfer roller 25 (second transfer). Thereafter, the sheet is fed to a fixing unit 35, where the sheet undergoes a heating treatment for fixation of the toner image thereon. Then, the sheet is ejected to a printed-sheet tray 5 provided on an upper surface of the printer body. In this embodiment, the present invention is applied to the developing device 40 of the black imaging unit 10*k*. However, the present invention is applicable also to the developing devices 40 of the other imaging units 10*y*, 10*m* and 10*c*.

Structure of Developing Device; See FIGS. 2 and 3

Figure 2:
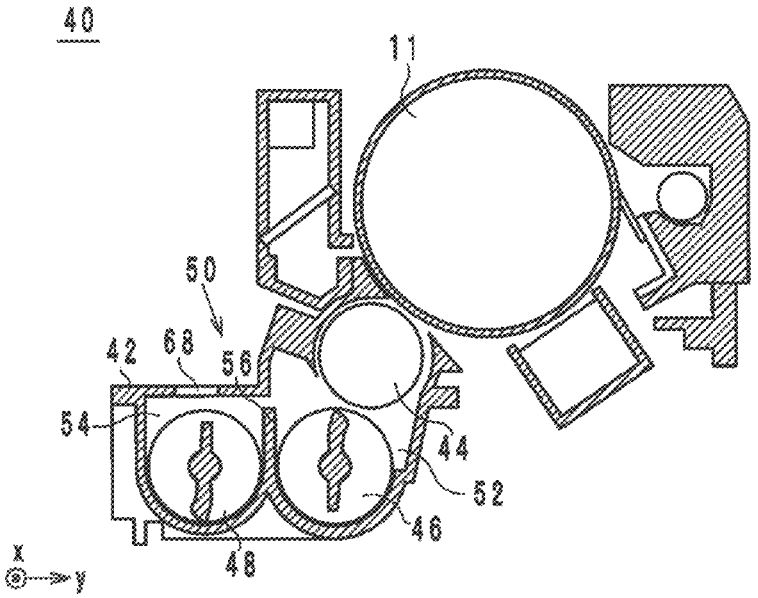
FIG. 2 is a sectional view of the developing device according to the embodiment, around a developing roller, when viewed from a direction parallel to a central axis of a supply screw of the developing device.

The developing device 40 according to this embodiment uses a two-component developer containing carrier and toner. The developing device 40 receives a developer supplied from the hopper 15 while discharging excess developer. As illustrated in FIG. 2, the developing device 40 includes a developing roller 44, a supply screw 46 and a stirring screw 48 arranged in parallel to one another in a casing 42. In the following, the direction in which the developing roller 44, the supply screw 46 and the stirring screw 48 extend is referred to as x-direction. The direction orthogonal to the x-direction and to the vertical direction is referred to as y-direction.

Figure 3:
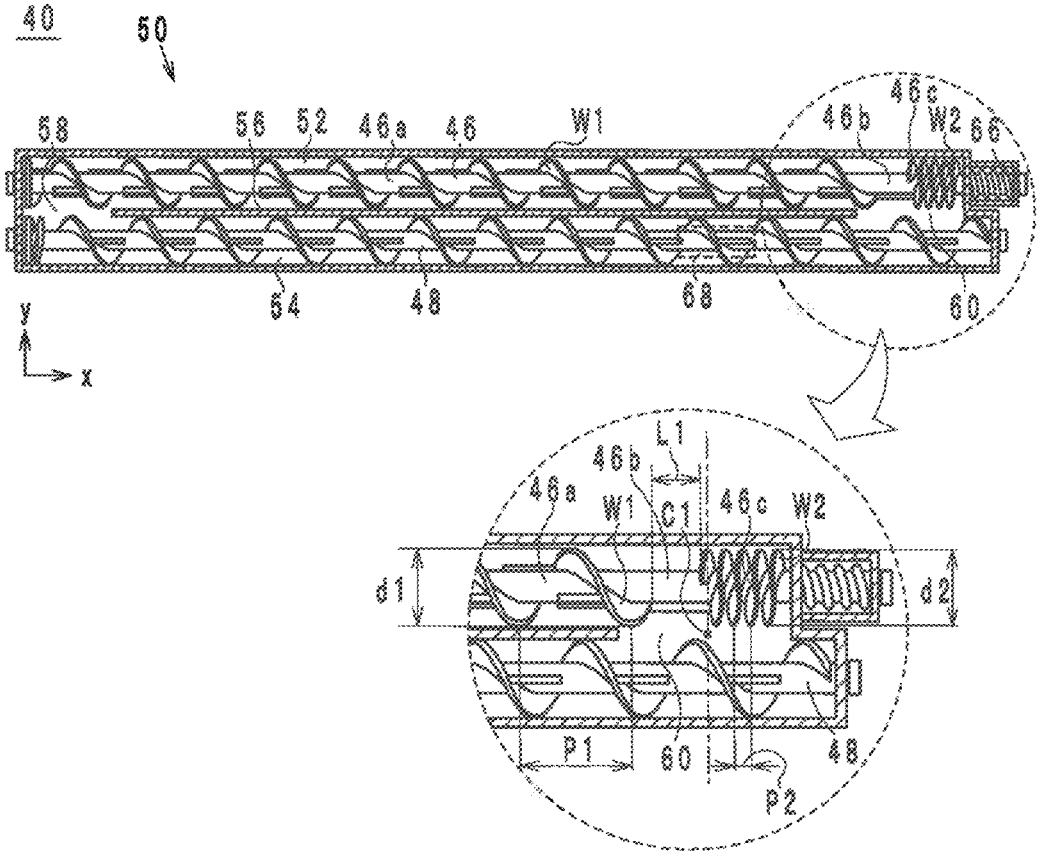
FIG. 3 is a sectional view of a developer tank of the developing device according to the embodiment, when viewed from a direction orthogonal to the central axis of the supply screw of the developing device.

The developing roller 44 is a sleeve including a plurality of built-in magnets (not illustrated in the drawings) having different magnetic poles, and is driven to rotate keeping a slight space from the photoreceptor drum 11. Underneath the developing roller 44, a developer tank 50 is provided. As illustrated in FIG. 3, the developer tank 50 is a container elongated in the x-direction, and the developer tank 50 is divided into two circulation tanks 52 and 54 by a partition wall 56 extending in the x-direction. The partition wall 56 is arranged such that an opening 58 is formed at a negative end in the x-direction of the partition wall 56 and such that an opening 60 is formed at a positive end in the x-direction of the partition wall 56.

The circulation tank 52 is a space from which a developer is supplied to the developing roller 44 and in which the used developer after development is collected. Therefore, at the positive end in the x-direction of the developer tank 52, an outlet 66 for the used developer after development is provided.

The circulation tank 54 extends along the circulation tank 52 with the partition wall 56 in between. The circulation tank 54 is a space in which the developer circulating in the tank 50 and the developer resupplied thereto through a resupply port 68 formed therein are stirred and mixed.

The supply screw 46 is provided in the circulation tank 52, and the stirring screw 48 is provided in the circulation tank 54. Each of the supply screw 46 and the stirring screw 48 has a cylindrical rotary shaft extending in the x-direction, and vanes are provided on the outer circumference of the cylindrical rotary shaft so as to be arranged spirally. The supply screw 46 and the stirring screw 48 serve to convey the developer.

The supply screw 46 is divided into three portions. In a portion 46*a* of the supply screw 46, which is from the negative end in the x-direction of the supply screw 46 to a point near the positive end in the x-direction of the supply screw 46 and farther in the negative x-direction than a middle point c1 of the opening 60 with respect to the x-direction, vanes W1 for conveying the developer in the positive x-direction are provided. The supply screw 46 also has a portion 46*b* next to the portion 46*a* and near the opening 60. In the portion 46*b*, no vanes are provided. The supply screw 46 still has a portion 46*c* next to the portion 46*b* and at the positive end in the x-direction of the supply screw 46. In the portion 46*c*, vanes W2 are arranged spirally in the direction opposite to the spiral arrangement of the vanes W1. The opening 60 stretches from a point overlapping with the positive end in the x-direction of the portion 46*a* provided with the vanes W1 to the positive end in the x-direction of the portion 46*c* provided with the vanes W2. The screw diameter d1 of the portion 46*a* provided with the vanes W1 is equal to the screw diameter d2 of the portion 46*c* provided with the vanes W2. The pitch P1 of the vanes W1 is greater than the pitch P2 of the vanes W2. The length L1 (the size in the x-direction) of the portion 46*h* provided with no vanes is smaller than the pitch P1 of the vanes W1 and greater than a half of the pitch P2 of the vanes W2.

As mentioned above, the stirring screw 48 is provided in the circulation path 54. The stirring screw 48 has vanes throughout the full length thereof. The stirring screw 48 serves to circulate the developer in the developer tank 50 and to stir and mix the developer resupplied thereto through the resupply port 68 made in the circulation tank 54. In this embodiment, the stirring screw 48 conveys the developer in the negative x-direction.

In the developer tank 50 of the developing device 40 having the structure above, the developer is conveyed in the positive x-direction in the circulation tank 52 by the supply screw 46 and comes into the stirring tank 54 through the opening 60. The developer that has come into the stirring tank 54 is conveyed in the negative x-direction by the stirring screw 48 and returns to the circulation tank 52 through the opening 58. Thus, the developer circulates in the developer tank 50 by flowing in the circulation tank 52 from the opening 58 to the opening 60 and flowing in the circulation tank 54 from the opening 60 to the opening 58.

When the pressure of the developer in the circulation tank 52 exceeds a predetermined value, a part of the developer conveyed in the circulation tank 52 flows to the positive end in the x-direction of the circulation tank 52 across the vanes W2 of the supply screw 46 without coming into the circulation tank 54 through the opening 60. The part of the developer coming to the positive end in the x-direction of the circulation tank 52 is discharged to the outside of the developing device 40 through the outlet 66. The portion of the circulation tank 52 having the outlet 66, that is, the positive end portion in the x-direction of the circulation tank 52 that is farther in the positive x-direction than the vanes W2 of the supply screw 46 is not connected to the circulation tank 54 in the y-direction.

Advantageous Effects

Figure 6:
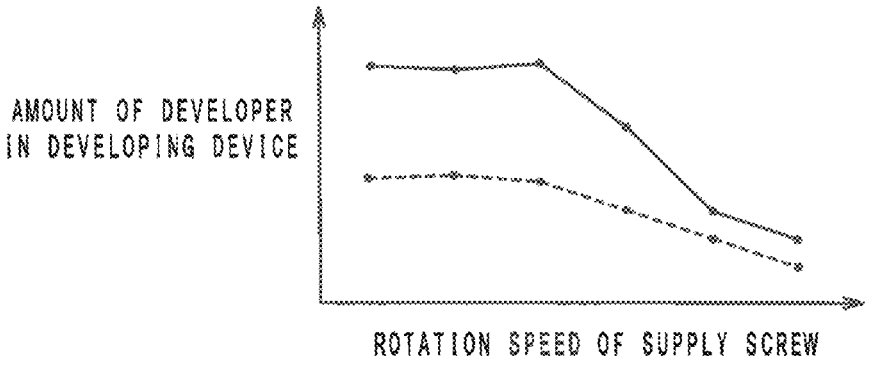
FIG. 6 is a graph indicating the relation between the rotation speed of the supply screw of the developing device according to the comparative example and the amount of developer circulating in the developing device.
Figure 9:
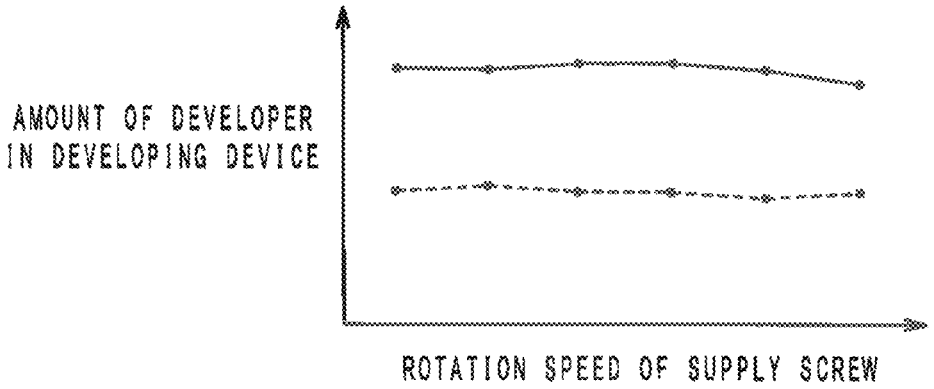
FIG. 9 is a graph indicating the relation between the rotation speed of the supply screw of the developing device according to the embodiment and the amount of developer circulating in the developing device.

The developing device 40 according to the embodiment and the image forming apparatus 1 comprising the developing device 40 are capable of maintaining the amount of developer in the developer tank at an appropriate level. In the following, this is described by comparison to a comparative example, which is a developing device 100 fabricated by removing the shutter system from the conventional developing device. FIGS. 6 and 9 are graphs indicating the relation between the rotation speed of the supply screw 46 and the amount of developer circulating in the developing device. In FIGS. 6 and 9, the vertical axis indicates the amount of developer circulating in the developing device, and the horizontal axis indicates the rotation speed of the supply screw 46. In FIGS. 6 and 9, the solid line indicates the relation between the rotation speed of the supply screw 46 and the amount of developer circulating in the developing device in a case where the developer tank 50 is tilted in such a direction as to make it difficult to discharge the developer, and the broken line indicates the relation between the rotation speed of the supply screw 46 and the amount of developer circulating in the developing device in a case where the developer tank 50 is tilted in such a direction as to make it easy to discharge the developer.

Figure 4:
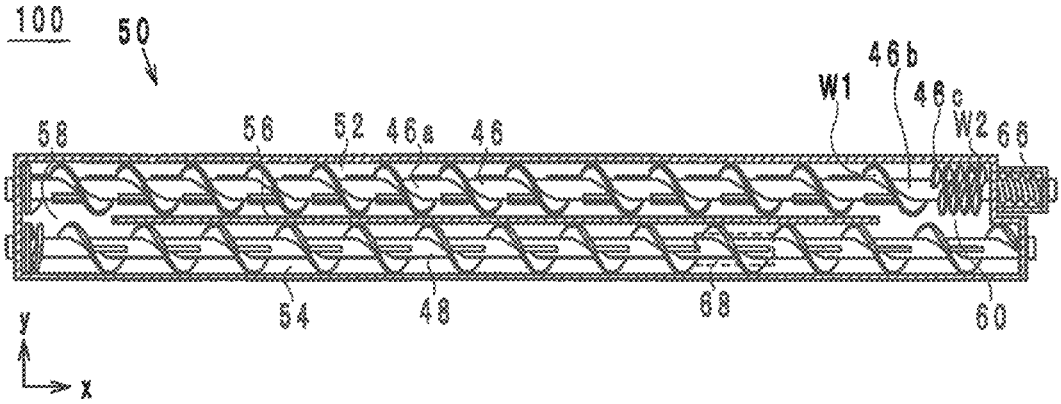
FIG. 4 is a sectional view of a developer tank of a developing device according to a comparative example, when viewed from a direction orthogonal to a central axis of a supply screw of the developing device.
Figure 5:
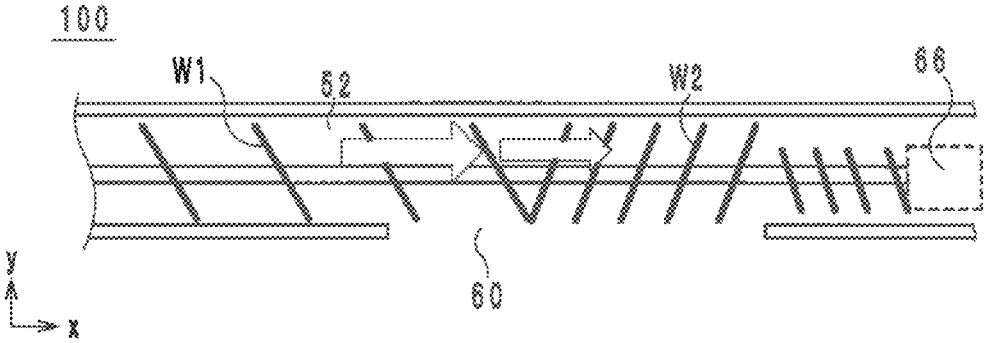
FIG. 5 is a schematic sectional view of the developer tank of the developing device according to the comparative example, when viewed from the direction orthogonal to the central axis of the supply screw of the developing device, illustrating the flow of a developer during high-speed rotation of the supply screw.
Figure 7:
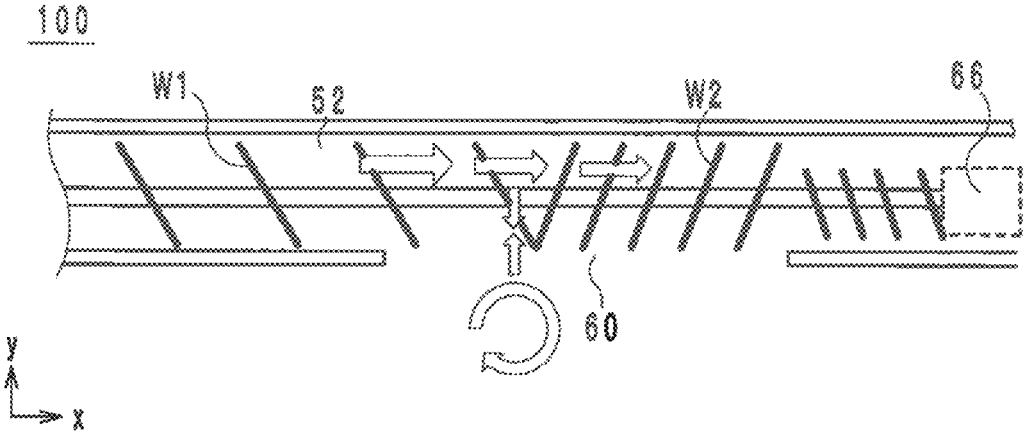
FIG. 7 is a schematic sectional view of the developer tank of the developing device according to the comparative example, when viewed from the direction orthogonal to the central axis of the supply screw of the developing device, illustrating the flow of a developer during low-speed rotation of the supply screw.
Figure 8:
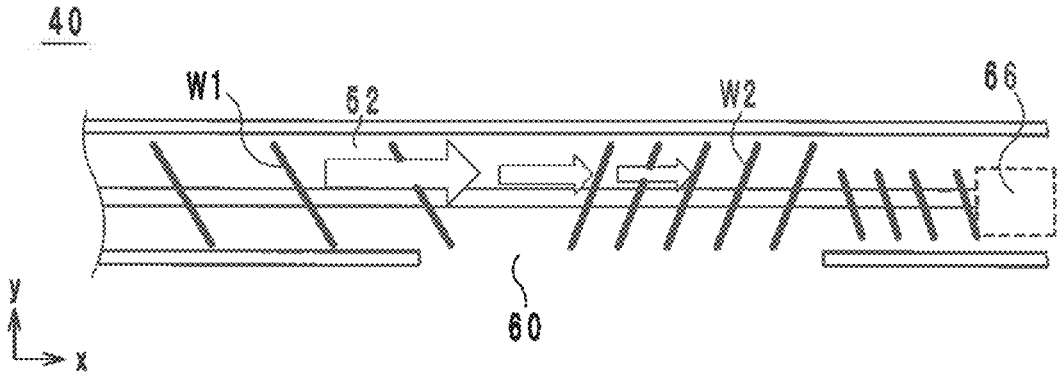
FIG. 8 is a schematic sectional view of the developer tank of the developing device according to the embodiment, when viewed from the direction orthogonal to the central axis of the supply screw of the developing device, illustrating the flow of a developer during high-speed rotation of the supply screw.
Figure 10:
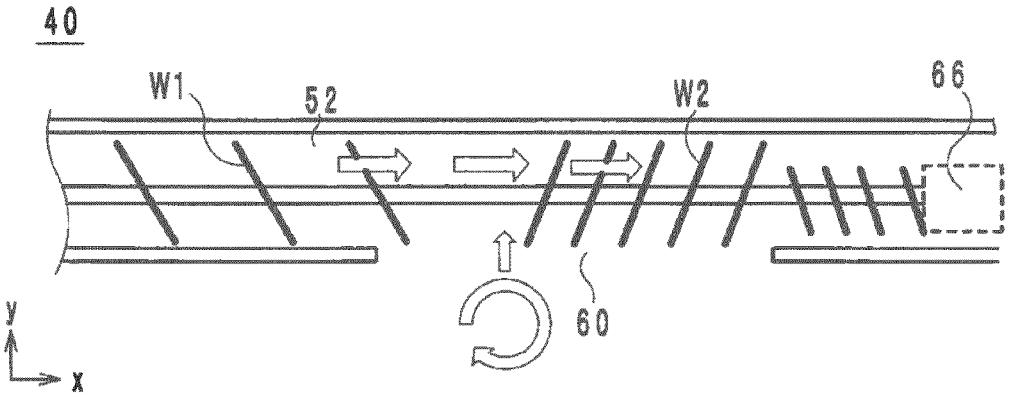
FIG. 10 is a schematic sectional view of the developer tank of the developing device according to the embodiment, when viewed from the direction orthogonal to the central axis of the supply screw of the developing device, illustrating the flow of a developer during low-speed rotation of the supply screw.

The developing device 100 according to the comparative example is different from the developing device according to the embodiment in the shape of the supply screw 46. In the supply screw 46 of the developing device 100, as seen in FIG. 4, the vanes W1 for conveying a developer in the positive x-direction are also provided near the opening 60, while in the supply screw 46 of the developing device 40, no vanes are provided near the opening 60. In the developing device 100 having such a structure, when the rotation speed of the supply screw 46 is high, as illustrated in FIG. 5, the supply screw 46 exerts an excessive pressure on the developer, and the amount of developer discharged from the developing tank 50 becomes larger than the amount of developer resupplied to the developer tank 50. Consequently, as indicated in FIG. 6, the amount of developer circulating in the developer tank 50 decreases drastically. However, when the rotation speed of the supply screw 46 is low, the pressure exerted by the vanes W1 of the supply screw 46 on the developer is balanced with the pressure in the opposite direction exerted by the vanes W2 on the developer. Further, as illustrated in FIG. 7, the pressure exerted by the supply screw 46 on the developer in the direction from the circulation tank 52 to the circulation tank 54 counteracts the pressure exerted by the stirring screw 48 on the developer in the direction from the circulation tank 54 to the circulation tank 52. Accordingly, only an appropriate amount of developer is discharged from the developer tank 50, and a decrease in the amount of developer circulating in the developer tank 50 is prevented. In the developing device 40 according to the embodiment, on the other hand, when the rotation speed of the supply screw 46 is high, as illustrated in FIG. 8, it is unlikely that the supply screw 46 exerts an excessive pressure on the developer because the supply screw 46 has a portion provided with no vanes near the opening 60. Accordingly, it is unlikely that a large amount of developer is discharged through the outlet 66. Thus, as indicated by FIG. 9, even when the rotation speed of the supply screw 46 is high, a sharp decrease of the amount of developer circulating in the developer tank 50 is prevented. When the rotation speed of the supply screw 46 is low, as illustrated in FIG. 10, a part of the developer flowing toward the circulation tank 54 is returned to the circulation tank 52 and flows to the outlet 66 because the supply screw 46 has a portion provided with no vanes near the opening 60. Accordingly, in the developing device 40 according to the embodiment, when the rotation speed of the developer supply screw 46 is low, a part of the developer flowing toward the circulation tank 54 is returned to the circulation tank 52 and goes to the outlet 66 although the vanes W1 of the supply screw 46 of the developing device 40 has a weaker force to convey the developer than the vanes W1 of the supply screw 46 of the developing device 100. Therefore, an appropriate amount of developer is discharged through the outlet 66. Thus, in the developing device 40 according to the embodiment, it is possible to maintain the amount of developer in the developer tank 50 at an appropriate level regardless of the rotation speed of the supply screw 46.

The developing device 40 according to the embodiment has a structure that no vanes are provided in a portion of the supply screw 46, and this structure permits the amount of developer in the developer tank 50 to be maintained at an appropriate level. This structure is very simple as compared to the conventional developing device having a shutter system in a developer tank. Further, in the simple structure, there is almost no risk of causing the problems that are possibly caused by the shutter system, such as closure of the outlet with the developer.

In the developing device 40 according to the embodiment, further, the portion of the circulation tank 52 having the outlet 66 is not connected to the circulation tank 54 in the y-direction. Accordingly, the developer coming toward the outlet 66 across the vanes W2 of the supply screw 46 is prevented from flowing into the circulation tank 54.

Modification; See FIG. 11

Figure 11:
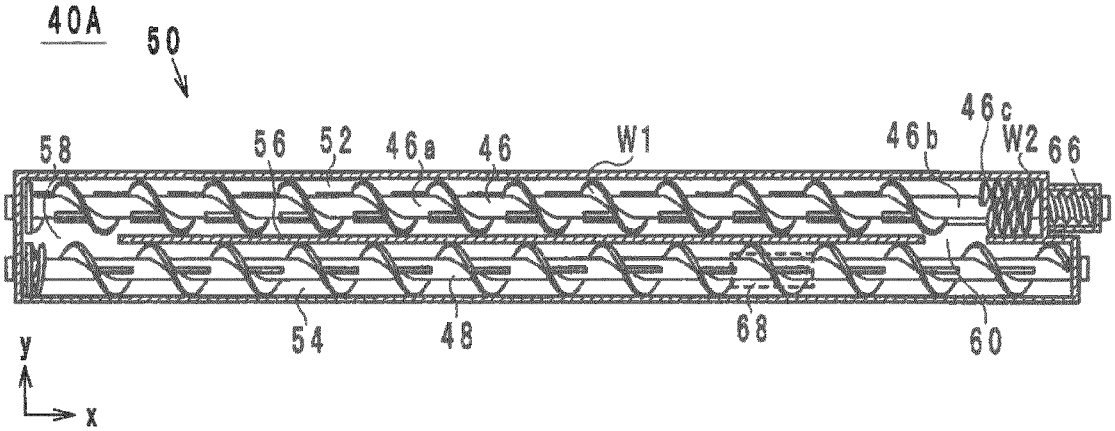
FIG. 11 is a sectional view of the developing device according to a modification, around a developing roller, when viewed from a direction parallel to a central axis of a supply screw of the developing device.

A developing device 40A according to a modification is different from the developing device 40 according to the above-described embodiment in the size of the opening 60 made in the partition wall 56. Specifically, as illustrated in FIG. 11, the opening 60 of the developing device 40A according to the modification stretches from a point overlapping with the positive end in the x-direction of the portion 46*a* provided with the vanes W1 to the negative end in the x-direction of the portion 46*c* provided with the vanes W2.

Thus, the opening 60 of the developing device 40A is smaller than the opening 60 of the developing device 40 according to the above-described embodiment. In the developing device 40A with the smaller opening 60, the portion 46*c* provided with the vanes W2 is separated from the circulation tank 54. Accordingly, the pressure of the vanes W2 to push back the developer in the negative x-direction is prevented from diverging toward the circulation tank 54, and appropriate circulation of the developer in the developer tank 50 is ensured.

OTHER EMBODIMENTS

Developing devices and image forming apparatuses according to the present invention are not limited to the embodiment and the modification described above. The shapes of the openings and the details of the vanes of the screws may be arbitrarily designed.

Although the present invention has been described in connection with the preferred embodiments above, it is to be noted that various changes and modifications may be obvious to persons having ordinary skill in the art. Such changes and modifications are to be understood as being within the scope of the present invention.

What is claimed is:

1. A developing device configured to develop an electrostatic latent image formed on an image supporting member with a developer containing toner and carrier, to be resupplied with a developer in proportion to toner consumption and to discharge a used developer, the developing device comprising:

a first circulation tank configured to discharge a part of the developer through an outlet while conveying the developer;

a second circulation tank divided from the first circulation tank by a partition wall, the second circulation tank configured to convey the developer conveyed thereto from the first circulation tank through a first opening in the partition wall and the developer resupplied thereto through a resupply port to the first circulation tank through a second opening in the partition wall such that the first circulation tank and the second circulation tank form a circulation pathway;

a first screw provided in the first circulation tank so as to convey the developer; and a second screw provided in the second circulation tank so as to convey the developer, wherein:

the first screw has a first vane in a first portion upstream from the first opening with respect to a conveying direction of the first screw, the first vane exerting a force in the conveying direction on the developer;

the first screw has no vanes in a second portion near the first opening;

the first screw has a second vane in a third portion adjacently downstream from the second portion with respect to the conveying direction, the second vane exerting a force in a direction opposite to the conveying direction on the developer;

the outlet is located at a point of the first circulation tank, downstream from the second vane with respect to the conveying direction;

a portion of the first circulation tank downstream from the second vane with respect to the conveying direction is not connected to the second circulation tank in a direction perpendicular to the conveying direction;

the first opening extends from a point overlapping with a downstream end of the first vane with respect to the conveying direction to a downstream end of the second vane with respect to the conveying direction, such that all of the second vane overlaps with the first opening; and the first screw receives the developer which is returned from the second circulation tank to the first circulation tank through the second portion, and conveys the received developer toward the outlet.

2. The developing device according to claim 1, wherein the second portion of the first screw has a size in the conveying direction smaller than a pitch of the first vane.

3. The developing device according to claim 1, wherein the second portion, which is provided with no vanes, of the first screw has a size in the conveying direction greater than a half of a pitch of the second vane.

4. The developing device according to claim 1, wherein a screw diameter of the first portion, which is provided with the first vane, of the first screw is equal to a screw diameter of the third portion, which is provided with the second vane, of the first screw.

5. The developing device according to claim 1, wherein a downstream end of the first portion, which is provided with the first vane, of the first screw is located at a point upstream from a middle point of the first opening with respect to the conveying direction.

6. The developing device according to claim 1, wherein a pitch of the first vane of the first screw is greater than a pitch of the second vane of the first screw.

7. An image forming apparatus comprising:
the developing device according to claim 1.

* * * * *